United States Patent [19]

Siminoff

[11] 4,433,603

[45] Feb. 28, 1984

[54] COMPONENT MUSICAL INSTRUMENT

[76] Inventor: Roger Siminoff, 112 Privada Luisita, Los Gatos, Calif. 95030

[21] Appl. No.: 444,449

[22] Filed: Nov. 24, 1982

Related U.S. Application Data

[63] Continuation of Ser. No. 146,682, May 5, 1980, abandoned.

[51] Int. Cl.[3] ..... G10H 3/00

[52] U.S. Cl. ..... 84/1.16; 84/1.15; 84/267

[58] Field of Search ..... 84/1.14, 1.15, 1.16, 84/267, 291

[56] References Cited

U.S. PATENT DOCUMENTS

| | | | |
|---|---|---|---|
| 3,771,408 | 11/1973 | Wright | 84/1.16 X |
| 4,027,570 | 6/1977 | Rendell et al. | 84/267 |
| 4,126,073 | 11/1978 | Takabayashi | 84/267 |
| 4,201,108 | 5/1980 | Bunker | 84/1.16 |
| 4,254,683 | 3/1981 | Nulman | 84/1.16 |

FOREIGN PATENT DOCUMENTS

| | | | |
|---|---|---|---|
| 52-08815 | 1/1977 | Japan | 84/1.16 |

*Primary Examiner*—F. W. Isen

*Attorney, Agent, or Firm*—James Reisman; David B. Harrison

[57] ABSTRACT

A musical instrument comprised of discrete detachably assembled components permitting easy change of said components. The instrument is provided with a center section and a main body section which furnish the central core for the interconnection of component parts such as the neck, multiple pick-ups and an electronic control module. Appropriate electrical connections are automatically made when the components are placed together.

12 Claims, 14 Drawing Figures

COMPONENT MUSICAL INSTRUMENT

This application is a continuation of Ser. No. 146,682, filed May 5, 1980, abandoned.

BACKGROUND OF THE INVENTION

1. Field of the Invention

This invention relates to stringed musical instruments, and, more particularly, to stringed musical instruments comprised of discrete detachably connected components, such design facilitating easy substitution of individual components in the event of defect, allowing selective "instant" alteration of the musical quality of a given component instrument, and generally permitting easier manufacture of stringed musical instruments.

2. Description of the Prior Art

In recent years, electronically amplified music has become quite popular, with a diverse range of musical compositions being played by musicians using "electric" instruments. Perhaps the most significant instrument in the presentation of such music is the electric guitar. A standard composition for example, require a bass electric guitar, as well as a standard range electric guitar, playing together or separately at any one time. Since these guitars are such major factors in modern popular music, it is not uncommon to see a musical group performing where a guitarist will have one guitar which he is playing and other guitars at the ready as spares or for any specialized needs of the musical program.

The use of a number of instruments to satisfy the demands of a given program, however, is not without problems. For instance, electric guitars are very expensive pieces of equipment, and, while a successful musician may be able to afford the outlay required in order to have the full complement of guitars that he may need or desire, the average amateur or young "up-and-coming" professional may be hard-put to maintain a full complement of instruments for his every need or desire. Furthermore, even for the musician who can afford to own many guitars and is willing to maintain more than one instrument, he then must face the burden of transporting many bulky, delicate instruments to each of his playing engagements.

Another problem associated with the use of conventionally constructed musical instruments is the inability to deal separately with defects or malfunctions which are confined to only one part or area of the instrument. For example, in common useage, a stringed musical instrument, and, more particularly, an electric guitar, will include a neck section, a center section, a body section, at least one pick-up, and a control panel. Such an instrument is assembled and wired as an integral unit. Consequently, a typical instrument, when damaged, is out of service for as long as repair will require. This out-of-service period can run from minutes to days to weeks, according to the availability of spare parts and repair services and the severity of the malfunction. When an instrument is owned to serve a specific need, however, any time that the instrument is out of service is too long.

Moreover, the manufacturing and assembling process also depends on uniformity of quality with respect to all sections of the instrument. Since the manufacture of stringed musical instruments is time-consuming and requires great skill and patience, as well as expensive materials, a fixed (i.e., integral) instrument is only as good as the combined quality of all of its elements. Thus, for example, a guitar with an excellent body section, center section, pick-up, and control panel will still be defective if its neck section is poorly made. The rectification of such defect—if rectification is possible—results in a great loss in time and money. While engineers and manufacturers have sought to obviate this problem, it still is a noted source in the industry of production losses to date.

Attempts have been made in the past to improve the design or manufacture of stringed musical instruments. For example, Maccaferri U.S. Pat. No. 2,793,556 teaches an adjustable method of mounting a neck to the body of a guitar. This method provides for secure attachment for a light weight neck to the frame of an instrument which can withstand the stresses of string tension present at the junction of the two elements. Wright U.S. Pat. No. 3,771,408 relates to a body for an electric guitar where pockets are provided for attachment of a guitar neck, a bridge and a tailpiece. Provision is also made for selective mounting of pick-ups and control elements. Copeland U.S. Pat. No. 3,910,151 teaches a collapsible stringed musical instrument which includes a rigid body section and a collapsible body section. Burke U.S. Pat. No. 3,072,007 discloses a guitar which may be sold in disassembled form, the invention providing for relatively permanent attachment of the elements of the instrument at some later point as desired.

The problem with the foregoing patents, as representative of the existing art in the field, is that an instrumentalist cannot choose to attach different pick-ups or control modules during a performance and immediately effect a replacement therefor with but a momentary interruption of the musical program. Another problem is that none of these designs provides for the easy replacement of the neck or body section of the instrument with other components of different playing characteristics. This ready changeability would be a great benefit to the instrumentalist because he could adapt his instrument to a given moment's needs, or could replace a defective element, with little or no inconvenience.

Considering the foregoing shortcomings, any improvement which can permit the "saving" of the serviceable portions of a defective instrument with a consequent limitation of the restrictions resulting from a defect, whether the defect is noticed during production or at the point of sale, will be heartily welcomed. Similarly, discrete availability of parts and sections of an instrument could facilitate the use of instruments by younger players, and can also promote more versatile playing by experienced musicians.

SUMMARY OF THE INVENTION

It is, therefore, an object of this invention to obviate one or more of the aforesaid inadequacies.

It is another object of this invention to provide a stringed musical instrument comprised of discrete component elements.

It is yet another object of this invention to provide a musical instrument that is easily kept in playing condition despite the malfunction of or damage to a component part.

It is a further object of this invention to provide a stringed musical instrument of greater musical versatility and range than a standard fixed instrument.

It is still another object of this invention to provide a stringed musical instrument comprised of discrete components, which components may be interchanged at will without the use of special tools.

It is also an object of this invention to make possible the "instant" selection and use of a variety of pick-ups, in a variety of positions on an instrument, to make available a variety of tonal responses thereof, which is not readily accomplished in fixed instruments.

Yet another object of this invention is to provide a component instrument which is easier and less expensive to manufacture than presently manufactured stringed musical instruments.

Additional objects and advantages of this invention will become apparent when considered in conjunction with one particular illustrative embodiment of the invention, wherein a typical component guitar includes a body section, a center section, a neck section, a pick-up module, and a control module. The body section and neck section are each detachably connected to the center section, with the neck section extending away from the location of the attached body so as to create a planar surface area; such planar area extends from the body to the neck and the strings may be strung across it. Each pick-up is detachably connected to the center section and lies underneath the strings so as to be able to sense the vibration of the strings and to translate this vibration into electrical energy. More than one pick-up may be attached to the instrument at any one time. The control module is provided with selected controls for adjustment of electronic circuits housed therein and is detachably connected to the center section; it also has switching capabilities to allow the player to choose between alternate pick-up locations. Means are also provided in the center section to securely receive and hold together the neck section, the base section, the pick-up and the control module.

Each of the foregoing components can be detachably connected to the center section with appropriate fasteners such as wing nuts, thumb nuts, slotted-head screws, or similar releasably securable devices, or by friction-holding means. Each of the components is shaped and fitted to assure proper alignment and positioning when attached to the center section.

The neck is made of wood, metal, plastic or similar material and is provided with accessories such as frets, tuning machines and other devices as are commonly required in a musical instrument. (The neck may be fitted with a truss structure such as that disclosed in my U.S. Pat. No. 3,901,119.) The end of the neck is machined to fit into the center section and may be provided with an internal steel plate into which a thumb nut or fastener may be threaded, for securing the neck to the center section.

The center section itself is comprised of aluminum, brass, zamac or other similar material, and is preferably made as a casting or an extrusion. The center section is structurally designed so as to withstand the forces and pressures commonly exerted on a stringed musical instrument, and is provided with an electrical ground field to join electronic components housed within it, as well as to provide protection from unwanted electrical "noise". All of the components detachably attach to the center section.

The body of the instrument can be fabricated from metal, plastic, wood or the like. Numerous body designs and shapes can be made available to provide for various fidelity or visual effects.

The pick-up module is made of metal, plastic, or the like, and clips, snaps, or fastens into the center section, at the same time making electrical contact therewith. Each pick-up module houses standard electro-magnetic components serving various musical ranges according to the electronic values of these components, and is provided with an electrical ground field. Multiple pick-ups may be used at any given time to provide for "front", "middle" or "rear" pick-up of musical vibrations from the strings.

The control module, similar to the pick-up, fastens into the center section and thereby completes an electrical circuit thereto. Components such as tone controls, volume controls, equalizers, and other tone modifiers, as well as switches for selecting pick-up combinations of "front", "middle" and "rear", will all be contained in the control module.

A component instrument in accordance with this invention incorporates standard devices, such as a tail-piece, bridge, winding machines strings and the like. Also, since external electrical connection is typically made to the instrument at the rear of the center section, means are provided to attach the external cord to the end of the body section so as to keep the cord out from under the instrumentalist's feet, as conveniently as possible.

It is, therefore, a feature of an embodiment of this invention that the main elements of a stringed musical instrument—the body section, center section, neck section, control module and pick-up module—are discrete units.

It is another feature of an embodiment of this invention that discrete components are provided which may be interchanged at will without the use of special tools.

It is yet another feature of an embodiment of this invention that components may be selectively replaced to facilitate "instant" repair of an instrument, or to permit "instant" change of an instrument's playing characteristics.

It is a still further feature of an embodiment of this invention that components of a musical instrument may be individually manufactured and assembled to create a versatile and variable playing unit having any desired characteristics.

It is also a feature of an embodiment of this invention that a variety and number of pick-ups may be attached to the instrument in various positions under the strings.

It is yet another feature of an embodiment of this invention that the interchangeability of an instrument's component parts permits variations in the number of strings used in the instrument.

BRIEF DESCRIPTION OF THE DRAWINGS

Additional objects, features and advantages of the present invention will become apparent when considered in conjunction with a presently preferred, but nonetheless illustrative, embodiment of the present invention as explained in the following detailed description and as shown in the accompanying drawings, wherein.

DESCRIPTION OF THE PREFERRED EMBODIMENT

The drawings illustrate the invention as embodied in an electric guitar, although it should be appreciated that the invention is applicable to a variety of stringed musical instruments, including banjos, mandolins, ukuleles, violins and the like. The main components of the invention, to be described hereinafter, are a body section, a center section, a neck section, a pick-up module and a control module. These parts are interconnected with the several other sections detachably connected to the center section.

Figure 1:
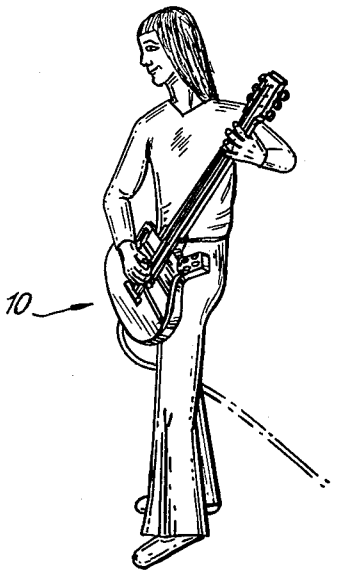
FIG. 1 is an illustration of an embodiment of the present invention as typically employed.
Figures 2, 2A, 2B:
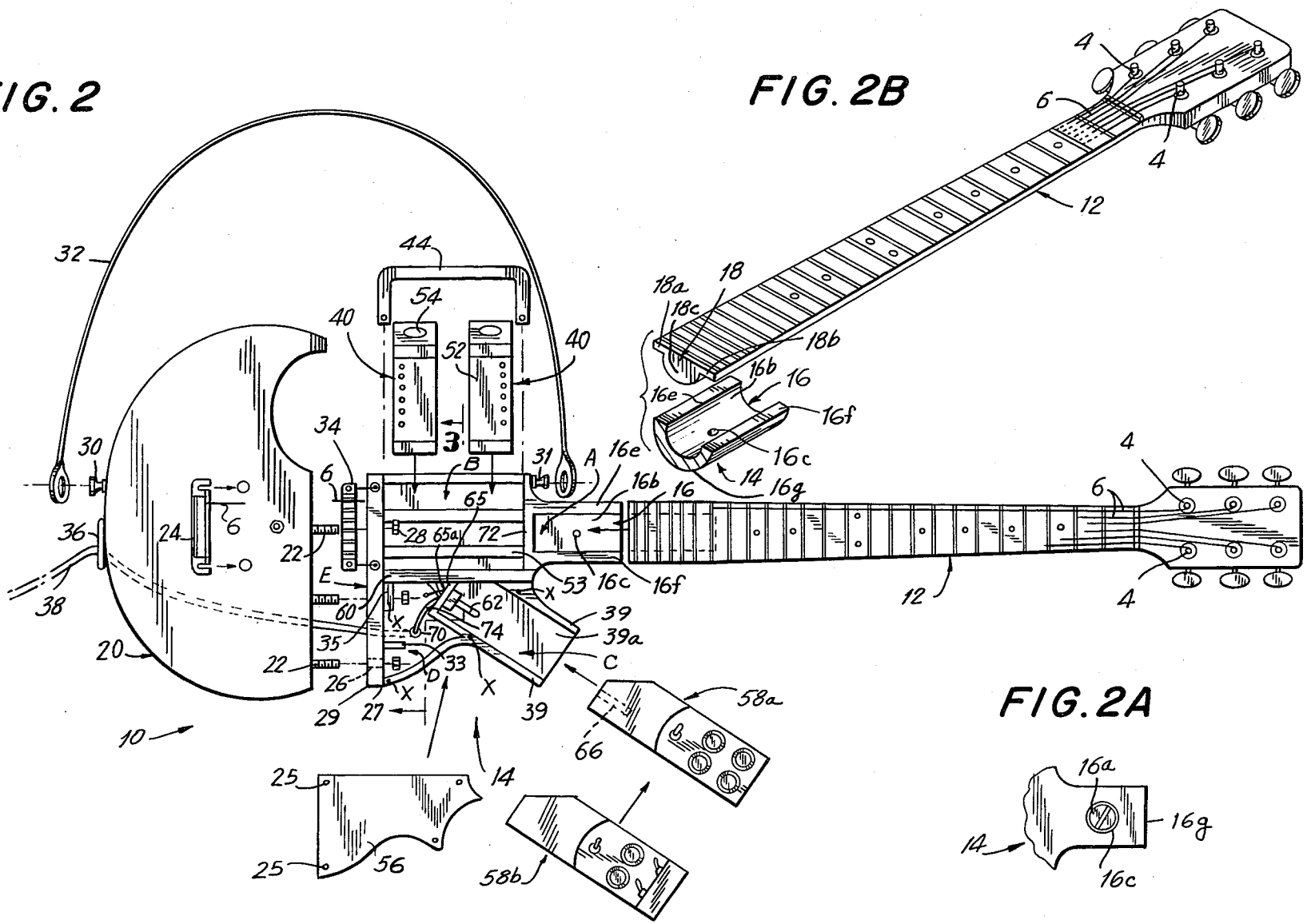
FIG. 2 is an exploded plan view of the invention showing components as typically interconnected to comprise an electric guitar.
FIG. 2A is a fragmentary rear view showing a portion of the center section.
FIG. 2B is a partial sectional view of the invention showing the neck portion mating with the center section.

The overall invention 10 is illustrated in FIG. 1, as a component electric guitar. As best seen in FIG. 2, the component guitar 10 is comprised of five major elements: neck section 12, center section 14, body section 20, control module 58*a*, and pick-up module 40.

Figure 7:
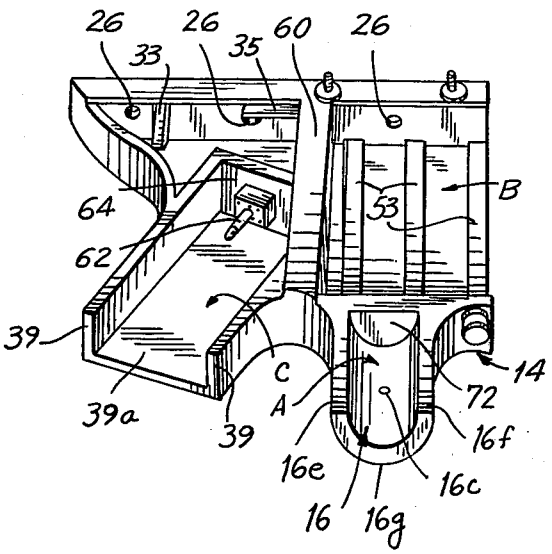
FIG. 7 is a top perspective view of the center section.

Center section 14, as best seen in FIGS. 2 and 7, is comprised, in part, of areas A–E which accommodate respective ones of the other major components. Neck section 12 detachably connects to center section 14 at area A. Pick-ups 40 detachably connect to center section 14 at area B. Area C provides a connecting channel to receive control module 58*a*. Electrical hook-up cord receptacle 70, wire bundle 74 and an internal junction panel 65 are affixed to center section 14 at area D, while body section 20 detachably connects to center section 14 at area E.

Neck section 12 mates with center section 14 at area A, as seen in FIGS. 2 and 2B; the neck section end portion 18 is "U"-shaped and snugly fits into channel 16 at area A, with end 18 abutting and adjoining wall 72, upon such fit. Flanges 18*a* and 18*b* of end 18 are positioned above center section channel edges 16*e* and 16*f*, respectively, when the neck section is fully mated with the center section.

The neck section 12 is secured to center section 14, upon mating therewith, by fastening means, such as a large slotted head screw. In a preferred embodiment, neck section 12 and center section 14 are securely but detachably interconnected by use of screw 16*a*, which is inserted from the rear of instrument 10 through bottom surface 16*g*, through annular opening 16*c* and through top surface 16*b* of center section channel 16, and is then securely mated with plate 18*c* of neck section 12. In one illustrative embodiment, annular opening 16*c* is flared outward toward the rear of the instrument so as to permit screw 16*a* to be countersunk in bottom surface 16*g* of center section channel 16.

Figure 3:
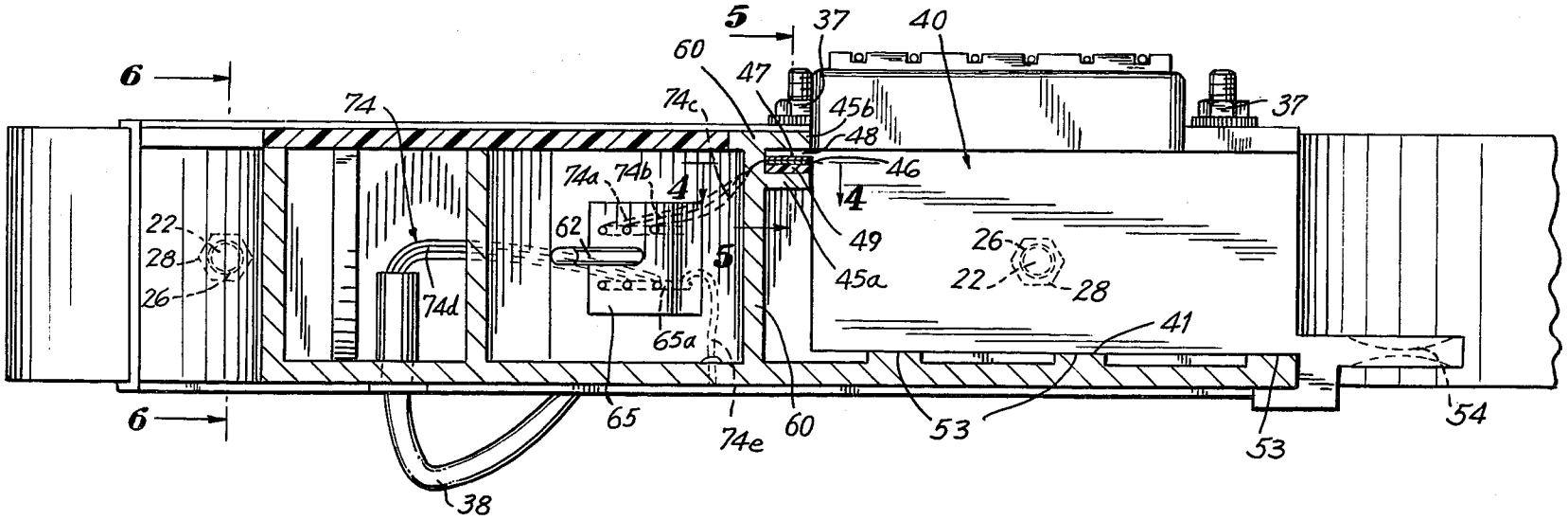
FIG. 3 is an enlarged sectional view of the center section, taken along the discontinuous line 3—3 of FIG. 2 in the direction of the arrows.
Figure 8:
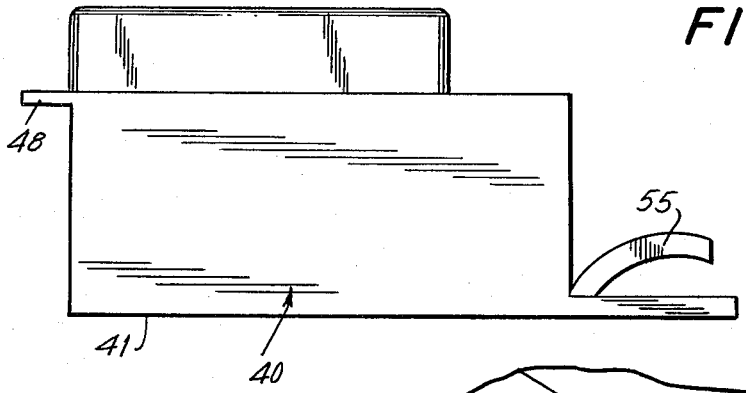
FIG. 8 is a side view of an illustrative embodiment of a pick-up.
Figure 9:
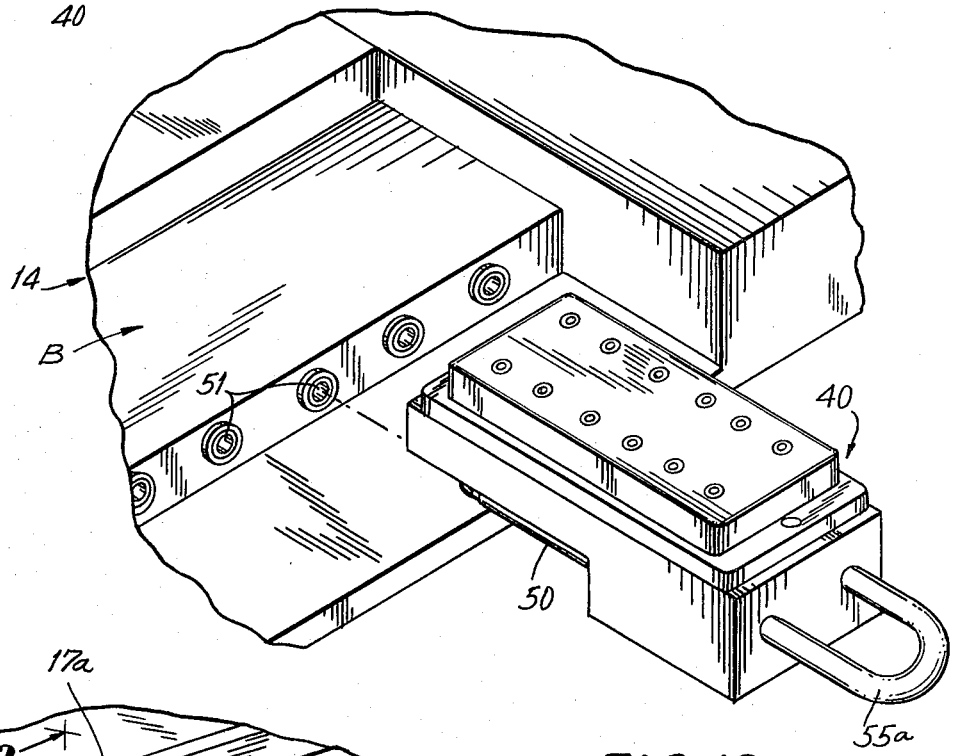
FIG. 9 is a fragmentary exploded perspective view of one embodiment of the invention showing a pick-up module and part of the pick-up receiving area of the center section.
Figure 10:
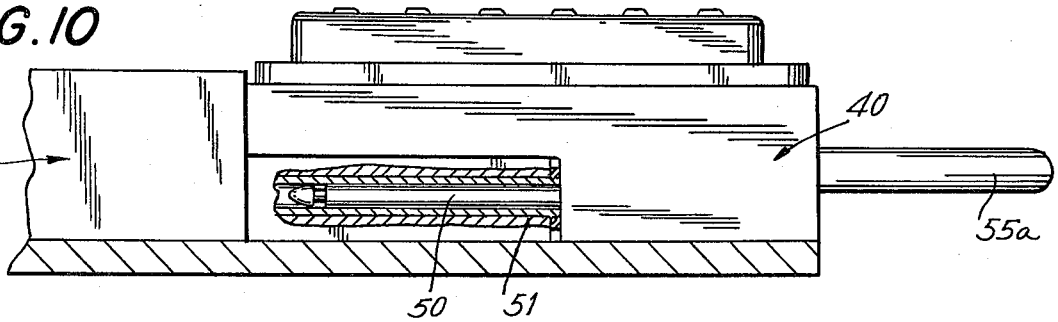
FIG. 10 is a fragmentary sectional view of one embodiment of the invention showing a pick-up mated with the pick-up receiving area of the center section.

The pick-ups 40, shown in FIGS. 3, 9 and 10, detachably connect to center section 14 at area B by connecting jack and receptacle 50 and 51. The central connective action of jack and receptacle 50 and 51 serves to detachably secure pick-ups 40 to center section 14 with handle 54 (FIG. 2) facilitating easy detachment of pick-ups 40 from center section 14. (Handles 55*a* (FIG. 9) and 55*b* (FIG. 8) are alternate configurations of handle 54).

Figure 5:
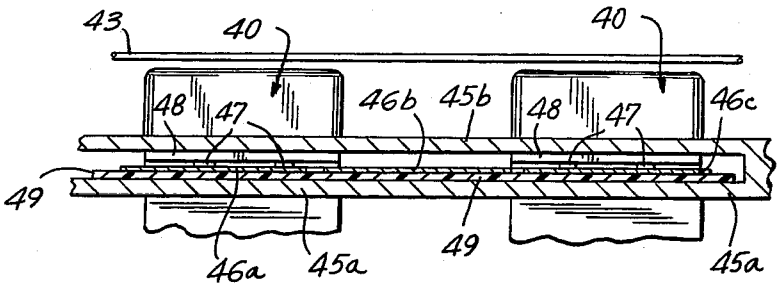
FIG. 5 is a fragmentary sectional view showing a portion of an alternate embodiment of the pick-up receiving area of the center section, taken along the line 5—5 of FIG. 3 in the direction of the arrows.
Figure 4:
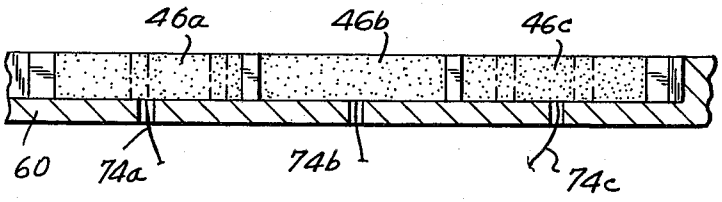
FIG. 4 is a fragmentary sectional view showing the electrical connection facility of an alternate embodiment of the pick-up receiving area of the center section, taken along the line 4—4 of FIG. 3 in the direction of the arrows.

In an alternate embodiment of this invention, illustrated in FIGS. 4 and 5, pick-ups 40 are electrically connected to the center section 14 by conventional contact strip means. The signal leg of the instrument's induction circuit is established by contact of conductive strips 46*a*, 46*b*, 46*c* located in the area defined by ledge 45*a*, ledge 45*b* and wall 60, with corresponding conductive strips 47 located on the underside of lip 48 of pick-up 40, as seen in FIGS. 3, 4, 5 and 8. The ground leg of the circuit is provided in a conventional manner, for example, by contact being made between conductive strips on bottom 41 of a pick-up 40 and corresponding conductive strips (not shown) on ridges 53 (see FIG. 7). As seen in FIG. 5, conductive strips 46*a*, 46*b* and 46*c*, are affixed to insulator 49, which in turn is affixed to ledge 45*a*. Electrical signals from pick-up 40 are transmitted from conductive strips 46*a*, 46*b* and 46*c* attached to wires 74*a*, 74*b* and 74*c* (FIG. 4), respectively, to junction panel 65. By proper observance of production tolerances, this arrangement also serves to physically secure pick-up 40 in its place in center section 14.

Control module 58*a*, or alternative embodiment 58*b* (FIG. 2), detachably connect to center section 14 at area C. Connectors similar to jacks and receptacles 50 and 51 may be employed to secure the control module 58*a* as well. An illustrative form of such a connector is shown in FIGS. 2 and 3, where center section 14 is provided with securing jack 62, and control module 58*a* is provided with corresponding securing receptacle 66. With this embodiment, the control module 58*a* will be electrically attached to the center section 14 upon mating of the connectors 62 and 66. The physical retention of module 58*a* within center section 14 is established in a preferred embodiment by a frictional fit accomplished between appropriately dimensioned module 58*a* and the cradle defined by support walls 39 and platform 39*a*.

It will be appreciated, however, that center section 58*a* and pick-ups 40 variously may clip, snap, plug, or the like into center section 14, as long as physically secure holding is achieved along with the establishment of appropriate electrical connection therebetween, and as long as various numbers of pick-ups may be attached to the instrument at any one time and in various positions under the strings.

Numerous components or circuits may be connected and housed in control module 58*a*, including, for instance, tone controls, volume controls, and selector switches, which allow the player to choose between front, front/middle and middle pick-ups. The latter selection ability is common to many electric guitars, although my invention makes such changes easier to accomplish.

Figure 6:
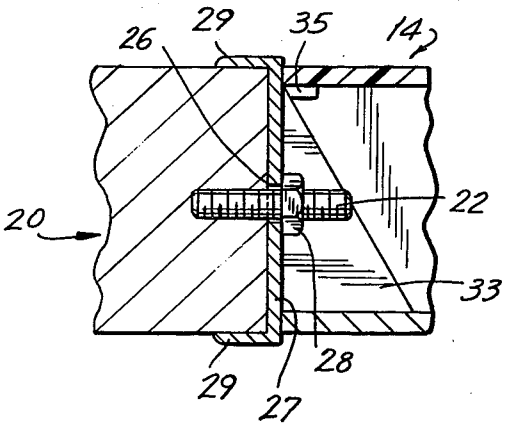
FIG. 6 is a fragmentary sectional view illustrating an alternative embodiment for connecting the center and body sections.

Body section 20 is mated with and secured to center section 14 at area E. In one embodiment (e.g., FIGS. 2 and 6), bolts 22 embedded into body section 20 mate with and are inserted through annular openings 26. Detachable connection of the body and center sections is then accomplished by use of nuts 28, or other hand-tightening means, attached to respective ones of bolts 22. As seen in FIG. 6, bolt 22, securely affixed to body section 20, is inserted through annular opening 26, whereupon nut 28 is tightened on bolt 22 against wall 27. Body section 20 is snugly secured thereby against wall 27 and between flanges 29, which assure firm attachment between the body and center sections. End wall 27 is formed to join with buttress 33.

Figure 11:
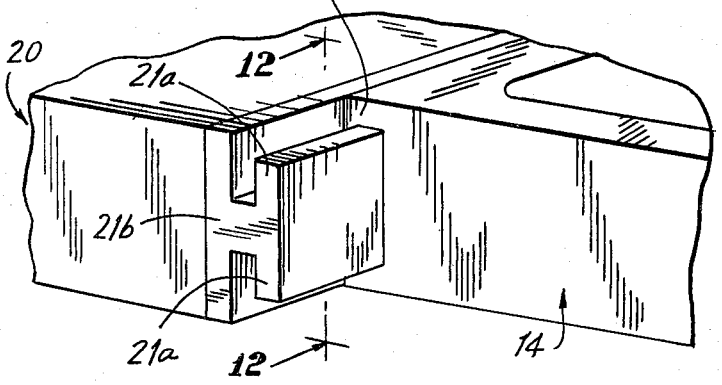
FIG. 11 is a fragmentary side respective view of a preferred embodiment of the invention showing means for mating the center section and the body section.
Figure 12:
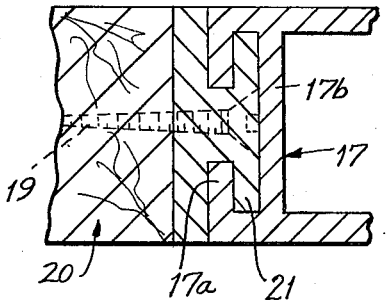
FIG. 12 is a fragmentary and partially sectional view showing the mating of the center section and the body section, taken along the line 12—12 of FIG. 11.

In one embodiment, body section 20 mates with center section 14 by means of a slip-in key and keyhole arrangement, as seen in FIGS. 11 and 12. Body section 20 is provided with key member 21 securely attached thereto by fastening screws 19. Key member 21 is itself defined by vertical flanges **21*a* and supporting pedestal 21*b*. Key member 21 mates with corresponding keyhole member 17 of center section 14, providing a secure attachment therebetween. Keyhole member 17 is defined by flanges 17*a* and wall 17*b* and is securely attached to center section 14 in a conventional manner. Keyhole member 21 and keyhole member 17 are constructed to provide suitable frictional adhesion therebetween upon mating thereof, so as to firmly secure body section 20 to center section 14**.

As shown in FIG. 2, the invention is also provided with shoulder strap 32, and posts 30 and 31 are provided for attachment of the shoulder strap. Tailpiece 24 is attached in a conventional manner to body section 20, as by screws, knurled knobs or the like. Similarly, bridge 34 attaches conventionally to center section 14. Each string 6 is attached at one of its ends to tailpiece 24; thereafter, each string is strung over bridge 34 and pick-up 40, respectively, and, after extending along the length of neck section 12, is then attached at its other end to winding machine 4.

Convenience handle 44 is attached to center section 14, permitting easy handling and lifting of an assembled instrument 10. Clip 36 secures electrical hook-up cord 38 to body section 20 to keep cord 38 out of the way of the instrumentalist.

Decorative cover 56 (FIG. 2) is attached to center section 14 at area D to hide from view internal wiring 74, **74*a*, 74*b*, 74*c*, 74*d*, and 74*e* (FIG. 3). Cover 56 is attached in any conventional manner, such as with screws (not shown) inserted through holes 25 and threaded into center section 14 at locations "X". Plate 35 is affixed to center section 14 to provide underlying support for cover 56**.

In a preferred embodiment, the electrical system of the invention includes electrical hook-up cord 38, receptacle 70, wire bundle 74, plug 62, receptacle means 66, junction panel 65, junction post **65*a*, and jumper wire 74*e*, and wires 74*a*, 74*b*, 74*c*, (FIGS. 2 and 3), and also connecting means 50 and 51 (FIG. 10), internal circuits of control module 58*a* and of pick-up 40** (not shown), and electrical ground fields for each component (not shown).

Electrical ground is provided to the invention by external hook-up cord 38 (FIG. 3). Wire **74*d* of bundle 74 carries this ground to junction panel 65 and is attached to post 65*a* thereof. This ground is then furnished to center section 14, as, for example, by attachment of jumper wire 74*e* between post 65*a* and a point on electrically conductive center section 14**, or on a conductive shield (not shown) within the center section if the center section is not electrically conductive.

Body section 20, pick-up 40, control module **58*a* and center section 14 are fabricated of or lined with suitable electrically conductive material to be able to carry the electrical "ground" therein. This ground is provided to reduce undesirable "noise", as might be picked up within any of the parts of the invention, and is also provided as the common leg of the signal circuit of the invention. The "ground" is made common throughout the instrument by typical means. For example, bolt 22, screw 16*a*, jacks 50 and 62 and their corresponding receptacles 51 and 66** provide appropriate electrical interconnection between respective components of the instrument.

In a typical embodiment of the invention, vibration of strings 6 (FIG. 2) is translated into electrical signals by pick-up 40. Pick-up 40 houses standard components (not shown) for the electrical induction of an electrical signal. The signal leg of this induction circuit is connected to center section 14 by jack 50 and slot 51. Wire **74*a*, 74*b*, and/or 74*c* (FIG. 4), depending upon location of the pick-up, carries this signal to junction panel 65 (FIG. 3) whereupon the signal is connected to control module 58*a* via jack 62. Output from the control module is returned to panel 65 and is then carried by bundle 74 to external cord 38** and to an external amplifier.

In a preferred embodiment of the invention, a plurability of pick-up receiving receptacles 51 are envisioned. These receptacles are located at area B of center section 14 and are interconnected in a conventional manner, facilitating "front", "middle", or "rear" placement of at least one pick-up under the strings.

TYPICAL OPERATION

In typical operation, an instrumentalist will select components which will provide specifically desired characteristics and features for his component musical instrument. The instrumentalist may choose among various types of modules or pick-ups, attaching one, two, or even three pick-ups to the center section at any one time, the pick-ups being secured to center section 14 in various combinations of "front", "middle", or "rear" positions under the strings, as desired.

Any selected neck section 12 may be detachably connected to the center section at area A, where channel 16 receives neck section end 18 (FIG. 2B); upon such connection, flanges **18*a* and 18*b* overlie channel edges 16*e* and 16*f*, respectively. In a preferred embodiment, secure mating is accomplished by seating "U"-shaped neck end 18 in channel 16, by fitting end 18 against wall 72, and by threading screw 16*a* through annular opening 16*c* and into bore 18*c* in the rear of neck section 12. When properly seated, neck section 12** effectively obscures area A from view.

Control module **58*a* is attached to center section 14 at area C. In a preferred embodiment, detachable connection of the module is accomplished by mating of jack 62 into slot 66, which also provides electrical interconnection between control module 58*a* and center section 14**.

At least one pick-up 40 is attached to the center section at area B. In a preferred embodiment, jack 50 engages slot 51 to securely attach pick-up 40 in a detachable mode, and also to provide electrical interconnection between pick-up 40 and center section 14. At least one pick-up 40, and preferably two or three, may be attached in any location under the strings, limited only by and to the specific pick-up receiving configuration of the center section and the performer's needs.

Cover plate 56 is secured at area D of center section 14 by standard connecting means (not shown), while bridge 34 attaches to the center section 14 by standard hand-adjustable means, such as by a knurled knob. Tailpiece 24 is similarly affixed to body 20.

Once the appropriate components are assembled, strings are attached to the component instrument at tailpiece 24, stretched across bridge 34, strung over pick-up 40, extended up neck 12 and attached to tuning machine 4. Thereafter the strings must be tightened and tuned, and then the instrument is ready for use.

A handle 44 is provided for convenient carrying of the assembled instrument 10. Clip 36 retains wire 38 away under the performer's feet. Strap 32 is affixed to posts 30 and 31 to provide for shoulder support of the instrument.

In the event of damage, malfunction or program change, the control module or pick-up, for example, may be "instantly" replaced. The performer needs only to grasp the module or pick-up component and pull it out of its detachable attachment and substitute a replacement therefor. In a similar fashion, body section 20 and neck section 12 also may be easily replaced. First, the strings must be removed; then, the defective or undesired component must be detached and replaced by loosening and retightening, or other appropriate operation of respective fastening means. Then, the strings are restored, tightened and tuned. The instrumentalist now has a "new" instrument with which to continue his performance. If it is the center section 12 which requires replacement, it too can be easily replaced by detaching body section 20, neck section 12, pick-up 40 and control module 58*a*, and substituting a new center section element, whereupon the instrument may be appropriately reassembled.

Easy replacement may be made by a manufacturer or retailer upon discovery of a defective component or upon a customer's request for a specific configuration of a stringed musical instrument, as never before possible. Such replacement may also be accomplished by the instrumentalist, and may be made in a surprisingly short period of time.

It will be appreciated that while the invention has been described with reference to particular embodiments, it is to be understood that these embodiments are merely illustrative of the application of the principles of the invention. Numerous modifications may be made therein and other arrangements may be devised without departing from the spirit and scope of the invention.

What I claim is:

1. A stringed musical instrument definable by the musician by assembly of tone producing playing strings and at least one each of the following types of discrete, interchangeable components, without need for hand tools to accomplish said assembly, said types comprising:

a. elongated neck section means for mounting at one end thereof a plurality of tuning means for tensioning each of said plurality of playing strings, said neck section means having first neck attachment means for enabling demountable attachment at another end thereof to main center section means, and defining an elongated fingerboard playing region between said ends thereof, b. end body section means for demountably attaching said strings at ends thereof opposite said tuning means at a common string mounting and demounting location and having first end body attachment means for enabling demountable attachment thereof to said main center section means, c. said main center section means comprising an elongated central body portion disposable between said elongated neck section means and said end body section means and defining second neck attachment means for demountably engaging said first neck attachment means at a first end region thereof and defining second end body attachment means for demountably engaging said first end body attachment means at a second end region thereof, said body portion defining a recessed longitudinal region lying between said first and second end regions thereof and directly below said strings, said region extending to and along an edge of said body portion between said first and second end regions, said body portion providing contact means in said recessed longitudinal region for attachment and electrical connection with at least one plug-in inductive pickup module means, said body portion further defining a chamber at an edge location generally opposite to said recessed region, for receiving electrical control module means, said body portion providing electrical connection means with said control module means when in said chamber, said connection means including circuit paths to said electrical contact means, d. at least one plug-in inductive pickup module means for plug-in attachment to and removal from said body portion and having electrical contacts for engaging said electrical contact means and having inductive pickup transducer means aligned adjacently below said strings when said pickup module means is attached to said body portion, and e. at least one plug-in electrical control module means for attachment to said body portion in said chamber and for thereby connecting to a said attached pickup module means, said control module means for controlling electrical signals generated by said pickup module means, whereby said pickup module means may readily be removed and replaced by the musician independently of removing and replacing said control module and without demounting of said strings.

2. The stringed musical instrument set forth in claim 1 wherein said first neck attachment means comprises a pair of opposed overhanging side flanges and a depending curvilinear portion between said flanges, and said second neck attachment means comprises channel means having a concave portion and opposed side edge surfaces for receiving, respectively, said curvilinear portion and said pair of opposed overhanging side flanges.

3. The stringed musical instrument set forth in claim 2 wherein said curvilinear and concave portions are substantially semicircular in cross-section and define apertures which become aligned when said neck section means is mounted on said main center section means, and further comprising removeable attachment securement means for securely attaching said curvilinear and concave portions through said aligned apertures.

4. The stringed musical instrument set forth in claim 1 wherein said end body section means comprises a pair of support posts at said common string mounting and demounting location and a demountable tailpiece securing said strings and adapted for demountable engagement with said posts.

5. The stringed musical instrument set forth in claim 1 wherein said contact means provided in said recessed longitudinal region comprises a plurality of longitudinally spaced apart, aligned, electrically connected contact sets which facilitate simultaneous attachment, connection and use of a plurality of said pickup module means and alternatively the use of one said pickup module at a plurality of selectable longitudinal locations, the spacing of said contact sets enabling selection of desired tonal effects induced from said strings during play.

6. The stringed musical instrument set forth in claim 1 wherein said first end body attachment means includes a plurality of rigid securement members mounted on a mating surface of said end body section means, and wherein said second end body attachment means includes a corresponding plurality of apertures defined in a receiving surface at said second end region of said central body portion, each said aperture for accomodating a corresponding one of said securement members, and securement means for fixing said securement members when they are inserted through said apertures thereby to bring said mating surface and said receiving surface into substantially confronting engagement.

7. The stringed musical instrument set forth in claim 6 wherein said rigid securement members are threaded bolts projecting from said mating surface and through said receiving surface to a rear portion thereof, and said fixing means are correspondingly threaded nuts adapted to be tightened against said rear portion of said receiving surface to establish said substantially confronting engagement relationship.

8. The stringed musical instrument set forth in claim 1 wherein said electrical connection means in said chamber includes electrical plug means projecting into said chamber in alignment with plug-in movement of a said control module means therein, and said control module means having corresponding jack means for engaging said plug means when said control module means is in said chamber.

9. The stringed musical instrument set forth in claim 1 wherein at least one of said plug-in electrical control module means comprises preamplifier means having gain control means located thereon for access by the musician during play of the instrument.

10. In a stringed musical instrument of component elements assemblable by the musician without need for hand tools:

said instrument including an elongated neck section for mounting at one end thereof a plurality of tuning means for tensioning a plurality of playing strings, a plurality of playing strings, and a body to which said neck section is joined at its other end, said body including a tailpiece for commonly securing said strings at a location aligned with the longitudinal axis of said neck section, said body defining a recessed longitudinal region lying between said neck section and said tailpiece and directly below said strings, said recessed region including at least one edge running between said tailpiece and said neck portion, said edge lying in a plane which is substantially perpendicular to a plane containing said strings, said body portion providing contact means in said edge for attachment and electrical connection with at least one plug-in inductive pickup module means, and at least one plug-in inductive pickup module means for plug-in attachment to and removal from said body and having electrical contacts for engaging said electrical contact means and having inductive pickup transducer means aligned adjacently below said strings when said pickup module means is attached to said body, whereby said pickup module means may readily be removed and replaced by the musician during play of the instrument without demounting said strings thereof.

11. The stringed musical instrument set forth in claim 10 wherein said contact means provided in said recessed longitudinal region comprises a plurality of longitudinally spaced apart, aligned, electrically connected contact sets which facilitate simultaneous attachment, connection and use of a plurality of said pickup module means and alternatively the use of one said pickup module at a plurality of selectable longitudinal locations, the spacing of said contact sets enabling selection of desired tonal effects induced from said strings during play by the musician.

12. The stringed musical instrument set forth in claim 10 wherein said body further defines a chamber at an edge location generally opposite to said recessed region for receiving electrical control module means therein, said body providing electrical connection means with said control module means when in said chamber, said connection means including circuit paths to said electrical contact means, and at least one plug-in electrical control module means for attachment to said body portion in said chamber and for thereby connecting to a said attached pickup module means, said control module means for controlling electrical signals generated by said pickup module means, whereby said control module means and said pickup module means may be replaced independently of each other by the musician during play of the instrument and without removal of its said strings.

* * * * *